United States Patent [19]

Einhorn et al.

[11] 4,079,916

[45] Mar. 21, 1978

[54] LOCKING PULLEY ASSEMBLY AND METHOD OF MAKING SAME

[75] Inventors: Ruediger Einhorn, Katonah; Lee Richard Chasen, Port Chester; Karl Hannes, White Plains, all of N.Y.

[73] Assignee: Coats & Clark, Inc., Stamford, Conn.

[21] Appl. No.: 729,013

[22] Filed: Oct. 4, 1976

Related U.S. Application Data

[62] Division of Ser. No. 630,717, Nov. 10, 1975, which is a division of Ser. No. 550,162, Feb. 14, 1975, Pat. No. 3,944,186.

[51] Int. Cl.[2] ..... B66D 1/36

[52] U.S. Cl. ..... 254/191; 308/15

[58] Field of Search ..... 254/191, 192, 190 R; 248/493; 308/15, 29, 8; 64/3, 4

[56] References Cited

U.S. PATENT DOCUMENTS

| | | | |
|---|---|---|---|
| 711,570 | 10/1902 | Hover | 254/191 |
| 718,447 | 1/1903 | Frampton | 254/191 |
| 968,547 | 8/1910 | Fries | 254/191 |
| 1,034,437 | 8/1912 | Fulton et al. | 254/192 |
| 1,648,933 | 11/1927 | Boyoe | 254/191 |
| 1,691,183 | 11/1928 | Forse, Jr. | 254/191 |
| 1,784,925 | 12/1930 | Campbell | 254/192 |
| 3,378,233 | 4/1968 | Fendig | 254/192 |

*Primary Examiner*—Trygve M. Blix
*Assistant Examiner*—Kenneth Noland
*Attorney, Agent, or Firm*—Burgess, Ryan and Wayne

[57] ABSTRACT

A locking pulley assembly includes a pulley adapted to be affixed to a surface, a pull handle, a swivel hook, and a cord extending between the swivel hook and the handle around the pulley wheel. The pulley includes a unitary pulley wheel having locking grooves and coaxial frustoconical bearing surfaces, the pulley wheel being mounted for rotation in a unitary frame having inwardly facing frustoconical bearing surfaces engaging the bearing surfaces of the pulley wheel to form a rotatable joint. The handle is comprised of a cylindrical member having a central axial hole with reduced diameter at its central portion for holding a knotted end of the cord. The handle also has a slot at each end thereof of width slightly less than the diameter of the cord, to enable the handle to hold the cord. The swivel hook has a first element adapted to be affixed to the other end of the cord, and a hook pivotally mounted on the first member. In the formation of the pulley, the frame and pulley wheel are sequentially cast, with the bearing surfaces of the first cast member forming the bearing surface part of the die for the casting of the second element. The frame is cast with bowed sides, and these bowed sides are straightened by compression to free the rotating joint.

1 Claim, 9 Drawing Figures

LOCKING PULLEY ASSEMBLY AND METHOD OF MAKING SAME

This is a division, of application Ser. No. 630,717, filed Nov. 10, 1975 which was a division of application Ser. No. 550,162 filed Feb. 14, 1975, now U.S. Pat. No. 3,944,186.

This invention relates to locking pulley assemblies, and is more particularly directed to a manually operable pulley assembly which may be employed, for example, for the hanging of a hanging plant or similar article. It will be understood, of course, that the various features of the invention may be also employed for other purposes, within the teaching of the invention.

It is frequently desirable to provide means for hanging a flower pot or the like, whereby the angular displacement and vertical height of the flower pot may be adjusted as desired, for example, for watering or maintaining a plant. Previous arrangements for achieving this function have generally employed hardware elements of purely functional design, or were of such design that their manufacture was costly. In the former case, the hardware items were undesirable for use in many locations, since they were not readily capable of being produced to have pleasing ornamental appearance. In the latter case, of course, the high costs of manufacture inhibited their use in many locations, for example in the hanging of flower pots in an average home.

The present invention is therefore directed to the provision of a pulley assembly that may be economically manufactured, while still presenting a pleasing appearance and retaining all of the desired adjustability features.

Briefly stated, in accordance with the invention, the pulley assembly comprises a pulley formed of a pulley wheel and a mounting frame for affixing the pulley to a desired surface, such as a ceiling. The pulley wheel is comprised of a cylindrical portion having coaxial end frustoconical bearing surfaces, a circumferential groove, and locking grooves joining the circumferential groove. The frame is comprised of top and bottom portions joined by bridging members having facing frustoconical surfaces which engage the frustoconical surfaces of the cylindrical pulley to provide a rotational joint.

The pulley is adapted to be formed by a die casting process, wherein the frame and pulley wheel are sequentially die cast, the frustoconical bearing surfaces of the first die cast element being employed as a die for the bearing surfaces of the second cast element. This casting process enables the inexpensive manufacture of the pulley, and is also adaptable to the provision of any desired ornamental features on the pulley.

In the manufacturing of the pulley, the frame may be initially cast with bowed sides, these bowed sides then being compressed to straighten them, and thereby separate the bearing surfaces to provide a free rotational joint between the pulley wheel and the frame.

The handle for the pulley assembly is preferably comprised of an elongated cylindrical member having a hole extending axially therethrough. The central portion of the hole has a reduced diameter, so that a cord extending through this portion and provided with a knot at its end will be inhibited from removal from the handle. The handle further has slots at its ends of a width slightly less than the diameter of the cord, so that the handle may be releasably locked to the cord in any desired manner, in order to take up the cord.

The cord extends from a handle around the pulley wheel of the pulley, and thence to a swivel hook having a first member affixed to the other end of the cord, and a hook member freely swivelably joined to the first member.

The arrangement in accordance with the invention thus enables an article suspended on the swivel hook to be adjusted to any vertical position and locked in such position, and also to be rotated to any desirable angular displacement. The handle may be readily held to the cord in any desired position, for example, so that it will not be visible.

In order that the invention will be more clearly understood, it will now be disclosed in greater detail with reference to the accompanying drawings, wherein.

Figure 1:
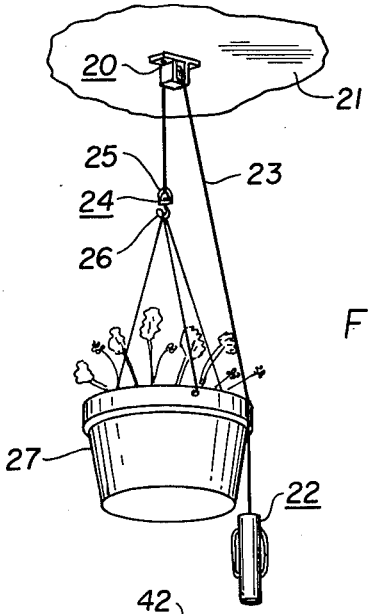
FIG. 1 is a simplified perspective view of a pulley assembly in accordance with the invention.

Referring now to the drawings, and more in particular to FIG. 1, therein is illustrated a simplified perspective view of a pulley assembly in accordance with the invention, as it may be employed in practice. The pulley assembly is comprised of a pulley 20 adapted to be mounted on a surface, such as ceiling 21 or a wall. A manually operable handle 22 is affixed to a cord 23 or the like, the cord extending around the pulley wheel of pulley 20, and thence to a swivel hook 24. The swivel hook 24 includes an upper member 25 adapted to be affixed to the cord 23, and a hook member 26 freely pivotably coupled to the member 25. The swivel hook may, for example, be of the type disclosed in copending application (Case U-Wp-1059). An article such as a flower pot 27 may be hung on the hook of the swivel hook 24.

In the arrangement of FIG. 1, the pulley 20 is of the locking type, and hence the flower pot 27 or any other article desired to be suspended may be adjusted in height by means of the handle, and locked in any desired position. Further, by employing a swivel hook, the flower pot or any other article suspended from the hook may be rotated to any desired angular displacement. This is particularly advantageous in the provision of means for hanging a plant, since it is frequently desired to rotate the plant in order to take advantage of available sunlight. As will be apparent in the following paragraphs, the handle may be wrapped up on the cord 23, or may be locked to any position on the cord, so that it does not dangle in an undesired manner, and may for example by hidden behind the pot or other suspended article.

The pulley 20 illustrated in FIG. 1 is preferably formed by die casting, and is readily adaptable to the die casting technique disclosed, for example, in U.S. Letters Pat. No. 2,818,494 wherein two elements to be pivotably intercoupled are sequentially cast, the first cast element having frustoconical bearing surfaces which serve as the die for the frustoconical bearing surfaces of the second cast element. This casting technique enables the economic manufacture of articles of the type wherein one element is pivotably or rotatably coupled to another element, and further enables the provision of a finished article having any desired ornamental design.

In the die casting of elements in accordance with the above technique, free pivotal or rotational movement between the elements is not obtained, due for example to unavoidable unevenness of the cast bearing surfaces. Various techniques have been suggested for the freeing of joints formed in the above manner. For example, in one technique, as disclosed in U.S. Letters Pat. No. 3,742,555, after the formation of the elements, one of the elements is staked or deformed to spread the bearing surfaces, and thereby free the joint. This technique is adaptable only to certain types of articles, such as hinges, and does not free the pivotal joint sufficiently, for example, to provide the rotational freedom required in a pulley wheel. In another technique for freeing a pivotal joint formed by the above casting method, means such as a wedge are forced into suitable spaces of the article, in order to spread the joint and hence free the pivotal movement. This technique undesirably increases the difficulty of manufacturing the articles, and is not readily adaptable to the production of some types of articles, wherein the dimensions of the element inhibits the use of the technique, due, for example, to the dimensions thereof or the force that would be required.

Figure 2:
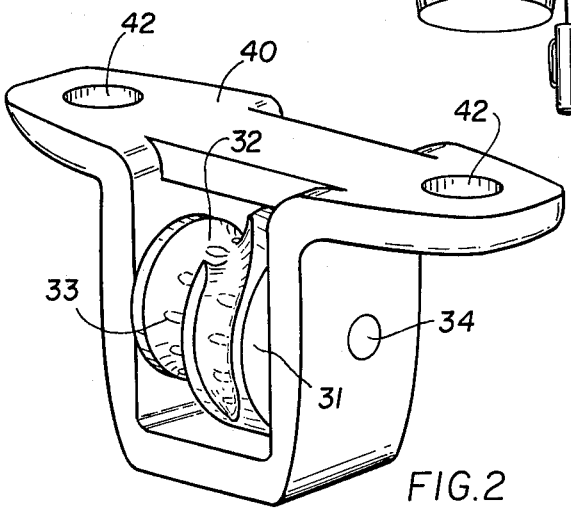
FIG. 2 is a perspective view of the pulley of the assembly of FIG. 1.
Figure 3:
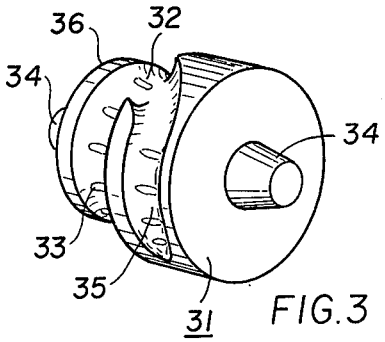
FIG. 3 is a perspective view of the pulley wheel of pulley of FIG. 2.

In order to overcome this problem, a pulley in accordance with the invention is cast in the form illustrated in FIG. 2. The pulley is comprised of a frame indicated generally by the numeral 30, and a pulley wheel 31. Referring to FIGS. 2 and 3, the pulley wheel 31 is a unitary cylindrical member of a die cast material having a circumferential groove 32 extending therearound for receiving a cord. If desired, the groove 32 may be provided with transversely extending ridges 33, in order to enhance the gripping force of the cord to the pulley wheel. The ends of the cylindrical body constituting the pulley wheel are formed with coaxial frustoconical projections 34, which serve as bearing surfaces. In addition, the circumferential surface of the pulley wheel is provided with at least one locking groove 35 extending from the groove 32 to one side thereof, the depth of the locking groove gradually diminishing as the distance from the groove 32 increases.

As seen in FIG. 3, the diameter of the cylindrical pulley wheel at the end 36 thereof adjacent the groove 32 may be less than the diameter of the wheel on the other side of the groove 32. The taper of the frustoconical bearing surfaces 34 may typically be 15° with respect to the axis of the cylindrical pulley wheel body. The dimensions of the groove 32 are of course dependent upon the cord employed in the assembly, and are such that the cross section of the cord is of substantially the same size as the groove 32.

Figure 4:
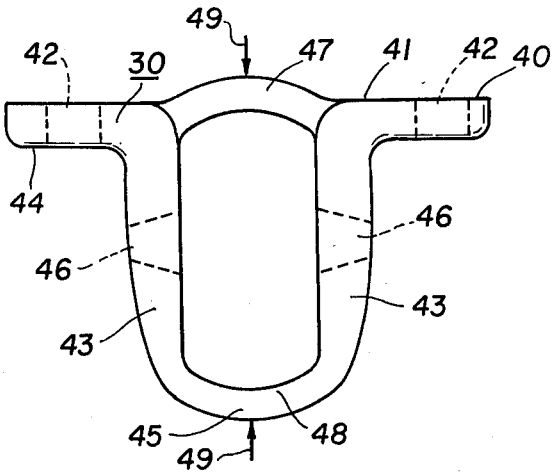
FIG. 4 is a plan view of the pulley frame of the pulley of FIG. 2, prior to its completion.

The pulley frame as cast, as more clearly illustrated in FIGS. 2 and 4, has a base portion 40 with an upper surface 41 adapted, when the pulley is completed, for engaging the surface on which the pulley is to be mounted. A hole 42 is provided in each end of the base portion 40, to enable the pulley to be mounted to a surface, for example, by means of conventional screws. Alternatively, a single screw may be embedded in the frame for mounting to pulley.

Displaced inwardly of the holes 42, a pair of spaced apart bridging portions extend substantially normal to the side 44 of the base portion opposite the surface 41, the ends of the bridging portions 43 joining the ends of a portion 45, whereby the portions 43 and 45 and the central part of the portion 40 define a frame.

Frustoconical apertures 46 are provided generally centrally in the bridging portions 43, the apertures 46 facing each other and being aligned. As illustrated in the figures, the larger diameter ends of the apertures 46 are directed towards each other.

As a further feature of the frame as cast, it is to be noted in the Figures that the central portion 47 of the base portion 40, and the portion 45 are bowed outwardly, i.e., away from each other, for a purpose that will be disclosed in greater detail in the following paragraphs.

Figure 5:
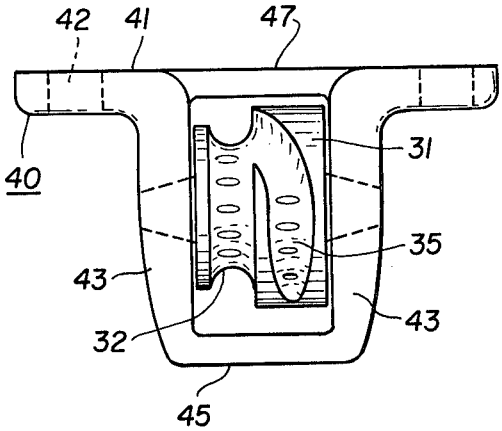
FIG. 5 is a plan view of the pulley of FIG. 1, with the pulley wheel assembled in the frame and the rotational joint thereof freed.

In the formation of the pulley illustrated in FIG. 2, one of the elements, for example the pulley wheel 31, is first cast of a die casting material, or by conventional techniques. This pulley wheel is then placed in a similar shaped cavity in a die which also has a cavity for forming the frame. The frame 30 is then cast, with the frustoconical bearing surfaces of the pulley wheel serving as the die for the frustoconical bearing portions of the frame. In view of this casting technique, the pulley wheel can be rotated within the frame, but the movement will be very stiff. This stiffness may result, for example, from unavoidable irregularities in the bearing surfaces. In accordance with the invention, in order to render the pulley wheel completely freely rotatable within the frame, compressive forces are applied between the frame portion 47 and the frame portion 45, as illustrated by arrows 49 in FIG. 4, whereby the portion 47 of the base 40, and the portion 45 of the frame are generally straightened and flattened, as illustrated in FIG. 5. This straightening of the bowed portions of the frame results in the spreading apart of the bridging portions 43, whereby the frustoconical surfaces of the frame and pulley are slightly moved apart to completely free the bearing surfaces for rotational movement. As a consequence, the pulley wheel as illustrated in FIG. 5 is freely rotatable within the frame. The compressive forces applied to the frame as indicated in FIG. 4, may be applied by conventional techniques, for example by a press, so that the freeing of the movement of the pulley wheel is effected by an inexpensive and simple technique.

In the arrangements of FIGS. 2–4, it was noted that the bearing surfaces of the pulley wheel were in the form of frustoconical projections, and that the bearing surfaces of the frame were in the form of frustoconical apertures. It is apparent, of course, that alternatively the bearing surfaces of the pulley wheel may be coaxial frustoconical apertures, into which frustoconical bearing surface projections of the frame project. Further, while the casting process above described referred to the initial casting of the pulley wheel, it will be apparent that alternatively the frame 30 may be cast first, with the pulley wheel 31 being thereafter cast employing the bearing surfaces of the frame as dies for the bearing surfaces of the pulley wheel.

Figure 6:
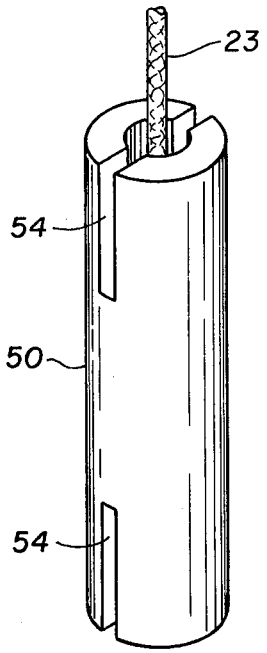
FIG. 6 is a side view of a handle of the assembly of FIG. 1.
Figure 7:
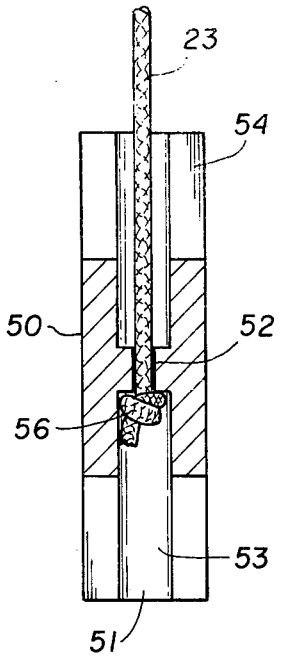
FIG. 7 is a longitudinal cross sectional view of the handle of FIG. 6, with the cord assembled therein.
Figure 8:
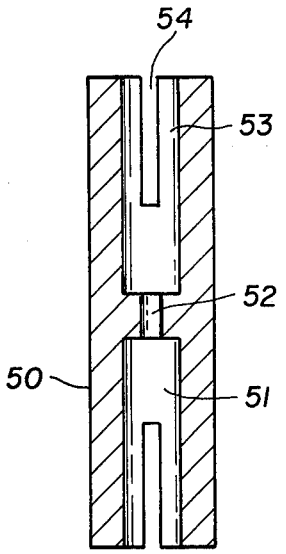
FIG. 8 is a further longitudinal cross sectional view of the handle of FIG. 6, taken in a plane at 90° from the view of FIG. 7.

The handle for the pulley assembly in accordance with the invention is illustrated in FIGS. 6–8. The handle is preferably in the form of an elongated cylindrical member 50 having a hole 51 extending axially therethrough. The diameter of the axially central portion 52 of the hole is substantially the same as the diameter of the cord to be employed in the assembly, whereas the diameter of the axial ends 53 of the hole is greater than the diameter of the portion 52, so that the cord may freely move therein. Alternatively, of course, only one end 54 of the hole may have a diameter larger than that of the central portion 52. Each axial end of the cylinder 50 is provided with a longitudinally extending slot 54, the slots in the two ends of the cylinder 50 being generally co-planar and intersecting the hole 51. The slots 54 have widths slightly less than the diameter of the cord to be employed in the device. The cylinder 50 may be formed of wood, or if desired, it may also be die cast or a plastic molding.

As illustrated in FIG. 7, the cord 23 extends into the hole 51 from one end 55 of the cylinder 50, passing through the central portion 52 of the hole. Beyond the central portion 52 of the hole, the cord is provided with an enlarged portion such as a knot 56, whereby the knot 56 will engage the lower side of the central portion 52 to inhibit removal of the cord from the handle.

Figure 9:
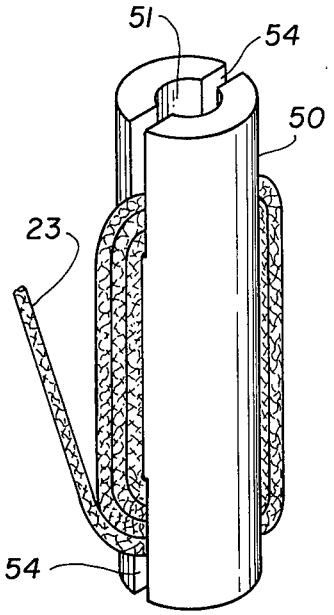
FIG. 9 is a perspective view of the handle of FIG. 6, with a cord shown wrapped therein, to illustrate one application of the handle.

As discussed above, the slots 54 have widths slightly less than the diameter of the cord 23. As a consequence, the handle may be easily clipped onto the cord 23, at any desired position of the cord, by inserting that portion of the cord in the slot 54. Alternatively, as illustrated in FIG. 9, the cord may be shortened effectively by wrapping the cord around the slots 54, the cord being retained in this wound state by virtue of the clamping action due to the width of the slots 54. As a result, it is apparent that the handle may be positioned as desired on the cord with the cord neatly wrapped therearound, for example so that it may be hidden behind the article suspended by the swivel hook, while still being readily unwrapped to facilitate the raising and lowering of the article.

In order to effect a locking action, the pulley frame 30 is dimensioned so that the clearance between the base portion 40 of the frame and the portion of the pulley wheel adjacent the end of the groove 35 is less than the thickness of the cord, so that the cord may be clamped or locked between the base portion of the frame and the pulley wheel adjacent the shallow end of the groove 35.

In one embodiment of the invention, the components of the pulley were die cast from Zamak #3 zinc die casting alloy. The base portion had a thickness of about 0.15 inches, with a width in its bowed portion of about 0.350 inches and a maximum width beyond the bowed portion of about 0.664 inches, whereby the renewed cross sectional area in the bowed portion facilitated the straightening of the base portion in the final step of production of the article. The radii of the bowed portions of the base portion 47 and the portion 45 were about 0.825 inches at the internal surfaces of the frame. The portion 45 had a thickness of about 0.125 inches and a width of about 0.35 inches. The bridging portions 43 tapered from widths of 0.35 inches at the portion 45 to about 0.664 inches at the base portion 40, and had thicknesses of about 0.18 inches. The pulley wheel had a maximum diameter of about 0.69 inches, with the clearance between the pulley wheel and the base portion 40 being about 0.04 inches.

While the method in accordance with the invention has been disclosed with reference to the production of a pulley of the locking type, it will be apparent that it may be employed also for freeing the pivot joints of other types of pulleys. For example, such other pulleys may be of the type generally of the form illustrated, but employing a pulley wheel without a locking feature. In this case, of course, the bowing of the pulley frame may be effected in a manner identical to the above-described method. The method in accordance with the invention may also be employed for freeing the pivots of a pulley adapted to be suspended by other techniques, for example a pulley having an eye for suspension, for example, from a hook, or a block and tackle. In this case, it is apparent that the initial cast shape of the pulley frame or frame for the block will be bowed or otherwise extended beyond its desired final position, with compression being effected to force the frame to its final position whereby the reshaping of the bowed or other shaped ends of the pulley effects the spreading apart of the members to completely free the pivot joint for the pulley wheel. Thus, the method in accordance with the invention may be employed for the production of marine hardware such as pulleys and the like.

In a further embodiment of the invention, the handle 22 described above may be omitted from the pulley assembly, with suitable conventional other means being employed to lock the assembly in position and take up the cord. For example, the pulley may be of the non-locking type, and the locking device for taking up the cord may comprise a conventional cleat (not shown) affixed to a wall adjacent the assembly. The non-locking pulley in this case may, of course, be of the type employing an eye for mounting, instead of having a mounting surface adapted to adjoin the ceiling or a wall, so that the pulley may be hung from the ceiling by a conventional preferably ornamental hook.

It is apparent also that the method in accordance with the invention is adaptable to the production of pulleys having more than one pulley wheel, in which case, of course, the method for freeing the pivotal joints as above described is employed with respect to each pulley wheel of the pulley.

While the invention has been disclosed with reference to a limited number of embodiments, it will be apparent that variations may be made therein, and it is intended in the following claims to cover each such variation and modification as falls within the true spirit and scope of the invention.

What is claimed is:

1. A locking pulley, comprising:

a pulley wheel comprising a unitary cylindrical body having a pair of end faces, a circumferential groove in said pulley wheel immediately adjacent one of said end faces, a locking groove extending in the circumferential surface of said pulley wheel adjacent the other end face thereof, the major portion of said locking groove being substantially parallel to said circumferential groove, one end of said locking groove communicating with said circumferential groove, the depth of said locking groove gradually diminishing as the distance from the circumferential groove increases, the portion of said pulley wheel containing said locking groove having a greater diameter than the portion of said pulley wheel containing said circumferential groove; and a unitary frame member having a U-shaped pulley wheel supporting portion comprising a pair of parallel side walls and an end wall, means associated with said side walls for rotatably supporting said pulley wheel with the end faces of said wheel parallel to said side walls, said frame member having a mounting flange extending from each of said side walls at the ends thereof remote from said end wall, said mounting flanges having co-planar mounting surfaces and means for securing each of said flanges to a fixed support, the adjacent portions of said pulley wheel and frame member having frustoconical surfaces, said pulley wheel and frame member being die-cast with the bearing surfaces of one of said parts serving as the die for the bearing surfaces of the other of said parts.

* * * * *